US007016780B2

(12) United States Patent
Graf et al.

(10) Patent No.: US 7,016,780 B2
(45) Date of Patent: Mar. 21, 2006

(54) METHOD, COMPUTER PROGRAM, AND OPEN- AND/OR CLOSED-LOOP CONTROL UNIT FOR OPERATING AN INTERNAL COMBUSTION ENGINE, AND INTERNAL COMBUSTION ENGINE

(75) Inventors: Marco Graf, Stuttgart (DE); Andreas Huber, Steinheim (DE); Marco Gangi, Esslingen (DE); Andreas Juergen Rohatschek, Wernau/Necker (DE); Udo Schulz, Vaihingen/Enz (DE); Jens-Holger Barth, Fellbach (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/504,264

(22) PCT Filed: May 28, 2003

(86) PCT No.: PCT/DE03/01739

§ 371 (c)(1),
(2), (4) Date: Aug. 9, 2004

(87) PCT Pub. No.: WO03/106829

PCT Pub. Date: Dec. 24, 2003

(65) Prior Publication Data

US 2005/0131623 A1 Jun. 16, 2005

(30) Foreign Application Priority Data

Jun. 14, 2002 (DE) ..... 102 26 506

(51) Int. Cl.
*F02D 41/20* (2006.01)

(52) U.S. Cl. ..... 701/114; 123/299

(58) Field of Classification Search ..... 701/114, 701/115, 102; 123/299, 480
See application file for complete search history.

(56) References Cited

U.S. PATENT DOCUMENTS

| | | | | |
|---|---|---|---|---|
| 6,271,618 | B1 | 8/2001 | Freudenberg et al. | 310/316.03 |
| 6,742,505 | B1 * | 6/2004 | Liskow | 701/115 |
| 2004/0255910 | A1 * | 12/2004 | Joos et al. | 123/490 |

FOREIGN PATENT DOCUMENTS

| | | |
|---|---|---|
| DE | 197 23 932 | 12/1998 |
| DE | 199 44 249 | 3/2001 |
| DE | 100 25 579 | 12/2001 |
| EP | 1 138 902 | 10/2001 |
| EP | 1 138 915 | 10/2001 |
| JP | 05-202790 | 8/1993 |
| JP | 2003-319667 A * | 11/2003 |

* cited by examiner

*Primary Examiner*—Hieu T. Vo
(74) *Attorney, Agent, or Firm*—Kenyon & Kenyon

(57) ABSTRACT

In an internal combustion engine, fuel is injected directly into a combustion chamber by an injector that has a piezoactuator. An electrical charge conveyed to and/or removed from the piezoactuator is ascertained by a method that is calibrated at least once during an operating time span of the internal combustion engine. To allow the calibration to be carried out or performed as often as possible, the method for ascertaining the electrical charge transferred to and/or removed from the piezoactuator may be calibrated during at least one triggering off-time (dtK) of the piezoactuator while the internal combustion engine is operating.

14 Claims, 5 Drawing Sheets

METHOD, COMPUTER PROGRAM, AND OPEN- AND/OR CLOSED-LOOP CONTROL UNIT FOR OPERATING AN INTERNAL COMBUSTION ENGINE, AND INTERNAL COMBUSTION ENGINE

FIELD OF THE INVENTION

The present invention relates firstly to a method for operating an internal combustion engine in which fuel is injected directly into a combustion chamber by an injector that has a piezoactuator, and in which an electrical charge conveyed to and/or removed from the piezoactuator is ascertained by way of a method that is calibrated at least once during an operating time span of the internal combustion engine.

BACKGROUND INFORMATION

European patent document no. 1 138 915 refers to a method in which, during charging of a piezoactuator of an injector, the transferred quantity of electrical charge can be determined. The corresponding quantity of electrical charge transferred during discharging of the piezoactuator can likewise be determined. This is accomplished by integration of a current signal. In order to reduce errors upon integration of the current signal and thereby to increase the precision with which the transferred charge quantity is ascertained, an alignment of the integration process, to be performed at specific points in time, is proposed. This alignment is to be performed, in particular, when the internal combustion engine is started. The reason for this is that ordinary control unit concepts and output stage concepts can operate only sequentially, so that an alignment cannot occur during triggering of the output stage or the piezoactuator.

SUMMARY OF THE INVENTION

An object of an exemplary method of the present invention is to provide that the electrical charge conveyed to and removed from the piezoactuator can be determined with even higher precision.

This object may be achieved, in the context of the method, in that the method for ascertaining the electrical charge conveyed to and/or removed from the piezoactuator is calibrated during at least one triggering off-time of the piezoactuator during operation of the internal combustion engine.

With the exemplary method according to the present invention, the electrical charge transferred to and removed from the piezoactuator that is ascertained can be aligned not only before the internal combustion engine is started, but also during normal operation thereof. Triggering off-times of the piezoactuator, which occur even during normal operation of the internal combustion engine, are used for this purpose.

This is because, in contrast e.g. to magnetic actuators, a triggering of the piezoactuator takes place or occurs only during the actual change in length of the piezoactuator. For a change in length of this kind, a specific electrical charge is transferred to, or a specific electrical charge is removed from, the piezoactuator. Between these triggering actions are triggering off-times in which the piezoactuator, and the output stage that generally triggers it, are "idle."

With the present alignment and triggering method, even though the individual actions are executed sequentially, an alignment of the method with which the charge transferred to and removed from the piezoactuator is ascertained can be performed while the internal combustion engine is operating normally.

Since alignment can be performed even during operation of the internal combustion engine, drift phenomena resulting, for example, from changes in the temperature of a control unit can be compensated for even during operation of the internal combustion engine. The precision with which the method for ascertaining the electrical charge delivered to and removed from the piezoactuator is performed may thus be greatly improved.

As a result of the more precise determination, according to the exemplary embodiment of the present invention, of the actuator capacitance, the actuator temperature can be more accurately ascertained. This may have a direct effect, however, on the linear stroke characteristics of the piezoactuator, and thus on the accuracy of the opening and closing behavior of an injector equipped with the piezoactuator. An accurate knowledge of actuator capacitance thus, ultimately, also allows the internal combustion engine to be operated more optimally in terms of emissions and consumption.

It is understood that the exemplary method according to the present invention can be used in the same fashion in both gasoline and diesel internal combustion engines. The use of, for example, an exhaust gas turbocharger and/or an exhaust gas recirculation system also does not conflict with utilization of the exemplary method according to the present invention.

In another exemplary embodiment, the calibration be accomplished with the injector open, in the triggering off-time between the end of an opening triggering action and the beginning of a closing triggering action. An open injector is present at each injection of fuel into the combustion chamber. Thus, the calibration may be performed at almost every working cycle of a cylinder of the internal combustion chamber (except during overrun of the engine, in which the injector remains closed). Such frequent calibration allows for reaction even to short-term fluctuations in the temperature of the control unit, thus considerably improving the accuracy of the method with which the charge conveyed to and removed from the piezoactuator is determined.

Calibration with the injector open may also have the advantage that the calculations required for this purpose can be performed relatively easily shortly before the injection. If it were desired instead to use the unoccupied phases between two injections for calibration, this would require laborious calculation because the end of one injection is known only shortly before the actual injection, and moreover the beginning of the subsequent injection would already have to be known. This may not usually be the case.

In addition, lead corrections may be necessary because of the dynamics of the internal combustion engine, since the respective beginning of an injection is referred to the crankshaft, whereas the duration of an injection has a time reference. This entire problem may be circumvented if the calibration is performed with the injector open.

Also, for each working cycle of a cylinder of the internal combustion engine, at least one secondary injection and one main injection may be provided, and the calibration be performed during a main injection. This injection type occurs more often than all other injection types, since the torque of the internal combustion engine is created principally by the main injection, and the main injection is therefore normally always performed (except during overrun or the like). In addition, the duration of the main injection is relatively long as compared with the other injection type (preinjection, postinjection, etc.), so that a comparatively long time is available for calibration.

Advantageously, a check may be made before a calibration, in a rotation-speed-synchronous dynamic interrupt, as to whether the time between two triggering actions is sufficient for a calibration. The reason for this is that the triggering duration may be calculated in a dynamic interrupt of this kind immediately before the injection. The triggering duration is defined here as the time span between the beginning of charging of the piezoactuator and the beginning of discharging of the piezoactuator. Subtracting the maximum possible charging time from the beginning of charging, i.e. from triggering initiation, yields the time remaining for a calibration. Performing the check in the rotation-speed, synchronous interrupt, as with the exemplary embodiment of the present invention, which may allow this check to be performed at the latest possible point in time, and therefore with greater accuracy.

The dynamic interrupt is thus also the ideal time at which to program the calibration itself. This is expressed in the exemplary method according to the present invention in which an instruction necessary for the calibration is determined in a rotation-speed-synchronous dynamic interrupt.

The calibration itself may be particularly accurate if it encompasses a plurality of individual calibration actions. To identify whether the triggering duration of the piezoactuator calculated in the dynamic interrupt is sufficient for one or more calibration actions, the following procedure may be used:

modulo (number of calibration actions)=triggering time/maximum time for a calibration instruction plus maximum charging time.

In another exemplary method of the present invention, the number of actions possible per working cycle of a cylinder is limited to a specific value, and only as many calibration actions as will permit all the intended injection actions to be performed are allowed during one working cycle of a cylinder. In this manner, therefore, a maximum possible number of actions may be ascertained a priori as a function of the absolute length of a working cycle, the injection actions having a higher priority than the calibration actions.

This can be implemented since an action coordinator firstly identifies the number of injection actions that have been ordered, and then determines the number of calibrations still possible. This may ensure that operation of the internal combustion engine is not impaired by the calibration actions. At the same time, however, there is an assurance that a calibration can be performed as soon as the "time window" required for it is open.

To a certain extent, the advantages according to the exemplary method of the present invention may already be achieved if a calibration action is scheduled not regularly at frequent intervals, but instead at least when the temperature of a control unit has changed by at least a specific value since the last calibration action. This reduces the computation load on the control unit and takes into account the fact that the temperature profile of the control unit has a considerable influence on the accuracy with which the electrical charge conveyed to and removed from the piezoactuator is determined.

In addition or alternatively thereto, a calibration action may be scheduled at least after expiration of a specific time interval, the duration of the time interval increasing in a defined manner after a startup of the internal combustion engine. This takes into consideration the fact that the temperature of the control unit changes relatively significantly after the internal combustion engine is started, whereas after a certain time it remains more or less steady. Calibrations are necessary only relatively seldom during this quasi-steady phase, which relieves stress on the control unit.

As an alternative to the aforesaid calibration operation with the injector open, the calibration can also be performed during an overrun condition of the internal combustion engine. During this overrun the injector is closed, i.e. is not being triggered, so that a relatively long period of time is available for calibration.

Given a certain driving style or corresponding traffic conditions, however, an overrun condition of the internal combustion engine may possibly occur only seldom or not at all. In addition, a number of tests, alignment or learning processes (e.g. injection quantity calibration), and a catalytic converter regeneration are performed during the internal combustion engine's overrun shutdown, making potential calibration difficult or impossible.

The exemplary embodiment and/or exemplary method of the present invention also concerns a computer program that is suitable for carrying out or performing the above method when it is executed on a computer. The computer program may be stored in a memory, in particular in a flash memory.

The exemplary embodiment of the present invention further relates to an open- and/or closed-loop control unit for operating an internal combustion engine, which unit encompasses a memory on which a computer program of the aforementioned kind is stored.

Also the subject matter of the exemplary embodiment and/or exemplary method of the present invention is an internal combustion engine having at least one combustion chamber, at least one injector that injects fuel directly into the combustion chamber, and at least one piezoactuator. In such an internal combustion engine, it may be advantageous if it encompasses an open- and/or closed-loop control unit of the aforementioned kind.

DETAILED DESCRIPTION

Figure 1:
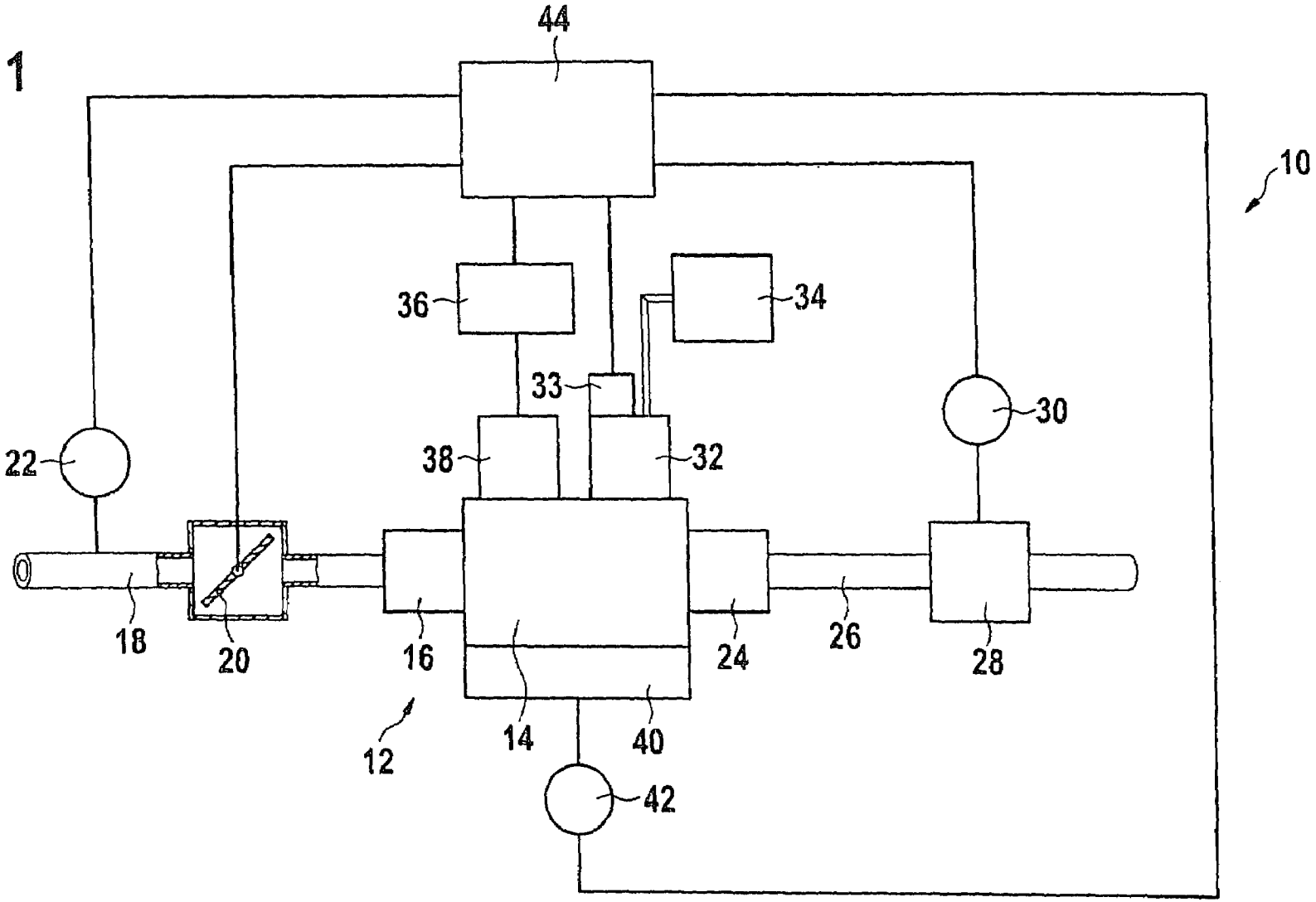
FIG. 1 schematically shows an internal combustion engine with direct fuel injection, encompassing an injector having a piezoactuator.

In FIG. 1, an internal combustion engine bears the overall reference character 10. It has several cylinders of which only the one having the reference character 12 is depicted in FIG. 1. It encompasses a combustion chamber 14 to which combustion air is conveyed through an intake valve 16 and via an intake duct 18. A throttle valve 20 controls the quantity of intake air conveyed, which in turn is sensed by an HFM sensor 22.

An exhaust valve 24 directs the exhaust gases into an exhaust duct 26, where they are purified by a catalytic converter 28 that has a lambda probe 30. Fuel is conveyed to the combustion chamber 14 by an injector 32 whose valve element (not depicted) is actuated by a piezoactuator 33. Fuel is made available to injector 32 at very high pressure from a fuel system 34. An ignition system 36 triggers a spark plug 38.

The rotation speed of a crankshaft 40 is picked off by a rotation speed sensor 42 which supplies a corresponding signal to an open- and closed-loop control unit 44. HFM sensor 22 and lambda probes 30 also supply signals to open- and closed-loop control unit 44. Open- and closed-loop control unit 44 triggers piezoactuator 33, ignition system 36, and throttle valve 20, inter alia.

It is known that the linear stroke characteristics of piezoactuator 33 depend on its temperature. The accuracy of the opening and closing behavior of injector 32 thus also depends on the temperature of piezoactuator 33. This in turn has an impact on the emissions and consumption behavior of internal combustion engine 10. An accurate knowledge of the temperature of piezoactuator 33 is therefore advantageous. One possibility for determining the temperature of piezoactuator 33 is based on knowledge of the capacitance of piezoactuator 33. That in turn can be ascertained by determining the electrical charge conveyed to and removed from piezoactuator 33.

These charge quantities are usually determined by integrating a current signal. The result of this integration also depends, however, on secondary factors. These include, for example, the temperature dependency of the properties of the electrical circuits of open- and closed-loop control unit 44. To allow the integration to be performed with high accuracy, an alignment or calibration is therefore necessary from time to time.

Since the processor used in open- and closed-loop control unit 44 can usually operate only sequentially, however, a time window in which it is certain that the processor is not occupied with other actions must be found for this alignment. As discussed in detail below, it is proposed in the present exemplified embodiment to use as the time window a triggering off-time that is present when injector 32 is open. Consideration is given, in this context, to the fact that the calibration encompasses a plurality of individual calibration actions, in the present case a total of three.

Figure 2:
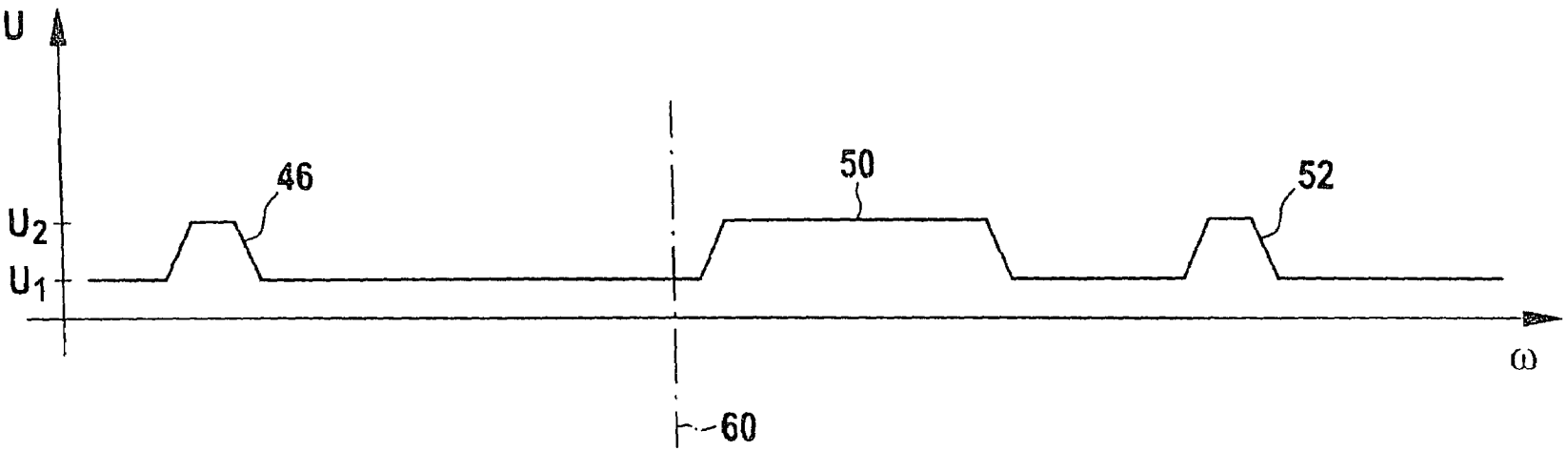
FIG. 2 is a diagram depicting the charge state of the piezoactuator of FIG. 1 as a function of crank angle.

FIG. 2 depicts the present voltage U of piezoactuator 33 during one working cycle of cylinder 12. A change in voltage U causes a change in the length of piezoactuator 33 and thus an opening or closing motion of the valve element of injector 32. As is evident from FIG. 2, in the instance considered here fuel is introduced from injector 32 into combustion chamber 14 by way of a total of three individual injections. In order to open injector 32 for an injection, piezoactuator 33 must modify its length. For an opening of injector 32, the charge state of piezoactuator 33 is changed, for that purpose, from a potential U1 to a potential U2. In the reverse order, the potential is modified in order to close injector 32 and terminate the injection.

Figure 3:
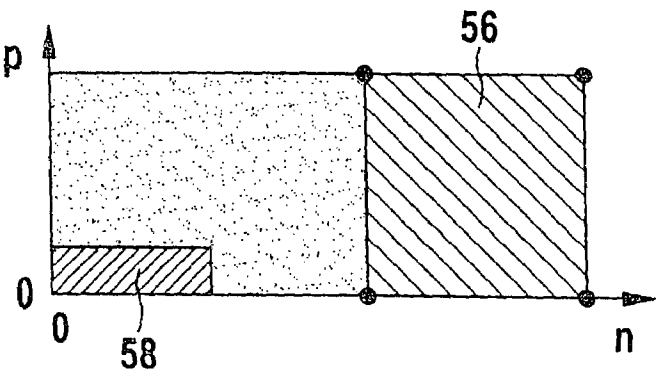
FIG. 3 is a diagram indicating how many injection actions are to be performed for a given pressure in a fuel system and a given rotation speed of a crankshaft of the internal combustion engine.

In FIG. 2 a first preinjection bears the reference character 46, a main injection the reference character 50, and a first postinjection the reference character 52. The number of possible injections depends on a variety of factors, including the fuel pressure p in fuel system 34 and the rotation speed n of crankshaft 40 (see FIG. 3). Because of the energy balance of control unit 44 and the volume balance of the high-pressure fuel pump (not depicted in FIG. 1), fewer injections take place at high rotation speeds (field 56 in FIG. 3) than at low rotation speeds and low fuel pressure (field 58 in FIG. 3).

Figure 4:
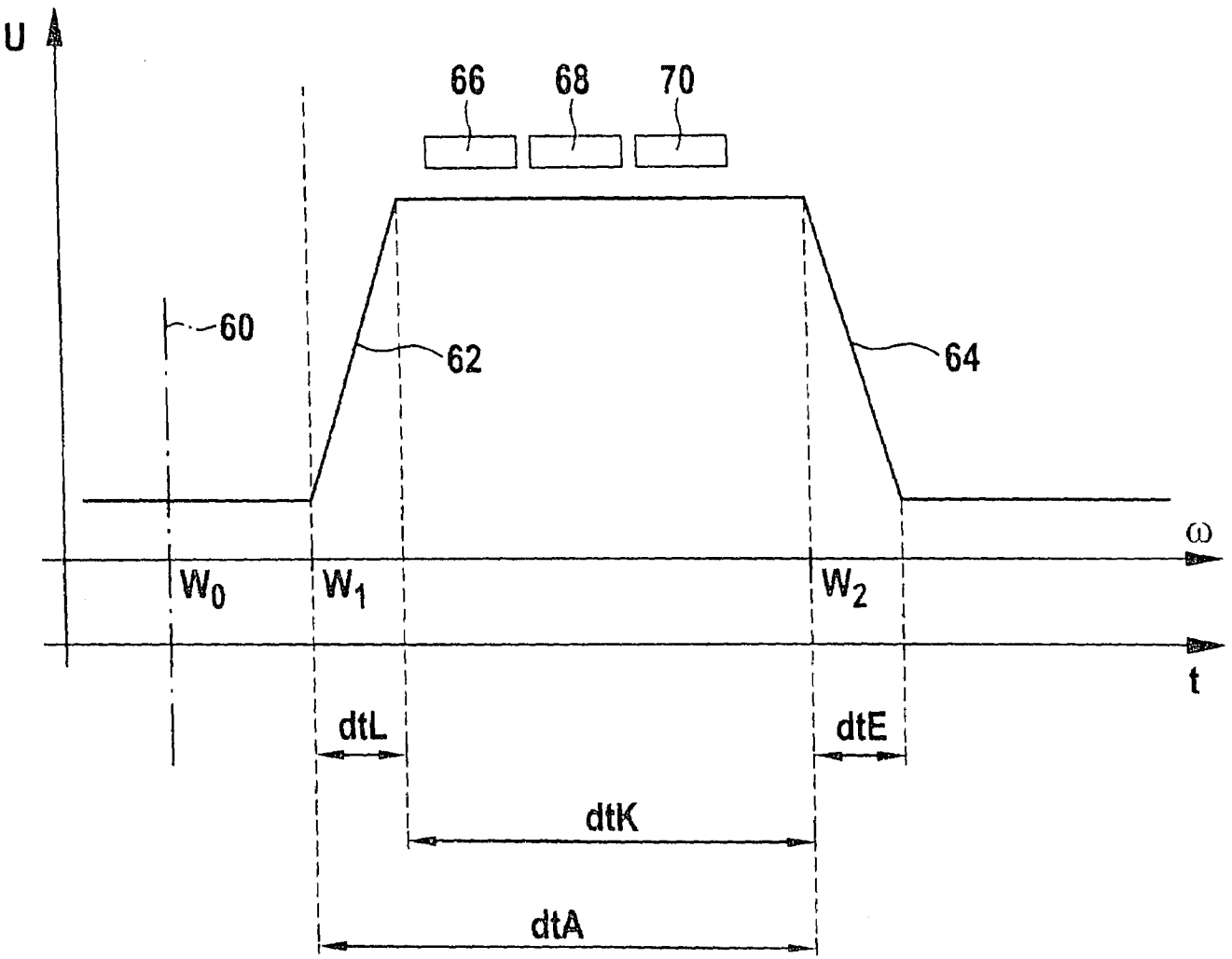
FIG. 4 is an enlarged portion of the diagram of FIG. 2.

The change over time in voltage U of piezoactuator 33 for main injection 50 is depicted in enlarged form in FIG. 4. It is evident from this that the data governing the duration of main injection 50 are determined at a crank angle W0 in a dynamic interrupt that bears the reference character 60 in FIGS. 2 and 4. Those data include the beginning of the discharging operation of piezoactuator 33, which in the present case is located at a crank angle W1. The beginning of the charging operation of piezoactuator 33 is ascertained in a static interrupt that is located earlier in time than the dynamic interrupt, and is not indicated in the Figure.

The beginning of the discharging operation of piezoactuator 33 is determined from a triggering duration dtA that is ascertained in dynamic interrupt 60 at crank angle W0. This is the time between the beginning of charging operation 62 and the beginning of a discharging operation 64 of piezoactuator 33. Subtracting the maximum possible charging time dtL of piezoactuator 33 from triggering duration dtA yields a time span dkK that is available for other actions.

The basis for all this is the fact that the processor used in open- and closed-loop control unit 44 can operate only sequentially. In the present case, the remaining "free" time dtK between the two triggering actions 62 and 64 of piezoactuator 33 is sufficient for three adjustment or calibration actions 66, 68, and 70. The fact that the processor of open- and closed-loop control unit 44 can carry out these three calibration actions 66, 68, and 70 was ascertained previously by an action coordinator whose operation will now be explained with reference to FIG. 5.

Figure 5:
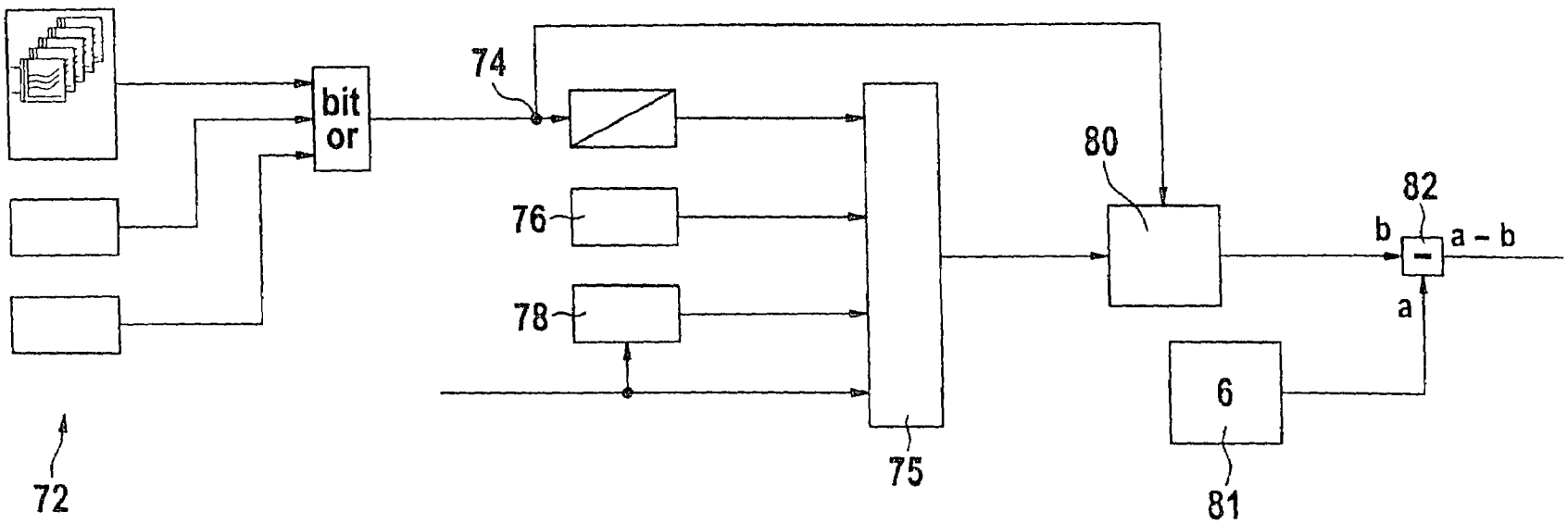
FIG. 5 is an execution diagram which is used to determine whether to schedule a calibration of a method with which the electrical charge conveyed to and removed from the piezoactuator of FIG. 1 is ascertained.

Reference character 72 in FIG. 5 refers to the enabling of the optimum number of injections for the present operating state (driver's requested torque, rotation speed, etc.). In 74, these injections are each given an individual priority. In block 75, the maximum number of injections permissible under the existing operating conditions is defined. This is accomplished by way of a minimum selection that depends, inter alia, on the charge state of an output stage (block 76) and on the delivery volume and delivery pressure of fuel system 34 (block 78).

If the maximum permissible number of injections defined in 75 is less than the number of injections enabled in 72 itself, a selection is made in block 80 of those injections which have the highest priority and whose quantity corresponds to the number ascertained in 75. Only those injections are carried out. In the present exemplified embodiment a total of three injections, i.e. preinjection 46, main injection 50, and postinjection 52, are permitted to be carried out.

In 81, the maximum number of actions that can be processed by open- and closed-loop control unit 44 between two static interrupts of the same type is made available (a separate static interrupt being allocated on the one hand to the preinjection and on the other hand to the main injection and postinjection, so that the number of static interrupts within two crankshaft revolutions is equal to the number of cylinders of the internal combustion engine multiplied by a factor of two). In the present exemplified embodiment it is six.

A subtraction in 82 then defines the number of actions still possible for calibration, which in the present case is three, corresponding to calibration actions 66, 68, and 70 of FIG. 4. This ensures that the injection actions take priority over the adjustment or calibration actions, but that the maximum number of calibration actions in the given circumstances can nevertheless be performed.

Figure 6:
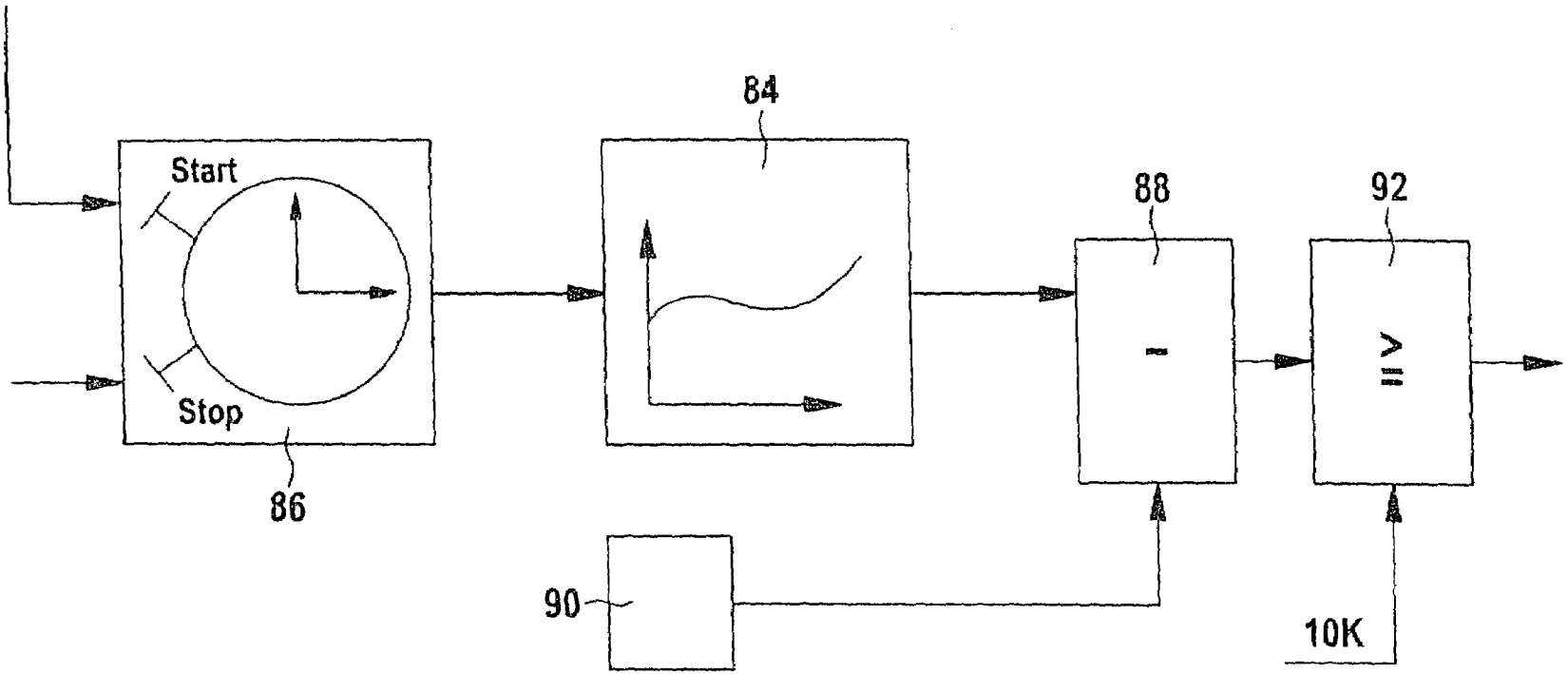
FIG. 6 is a block diagram of a method for coordinating various actions during operation of the internal combustion engine of FIG. 1.

FIG. 6 depicts a method which determines those instances in which any calibration actions at all are to be performed. The basis for this is an assumed temperature of open- and closed-loop control unit 44 that is ascertained by way of a characteristic curve 84. The time elapsed since internal combustion engine 10 was started (block 86) is fed into characteristic curve 84. Characteristic curve 84 yields as its output value the temperature of open- and closed-loop control unit 44 on the assumption of a certain starting temperature.

In 88, the difference is determined between the temperature ascertained by characteristic curve 84 and a temperature ascertained and stored at the last calibration, which is made available in block 90. In 92, a query is made as to whether the difference ascertained in 88 is greater than a specific temperature difference, in the present case 10 K. If so, a calibration is performed and the temperature ascertained in characteristic curve 84 is stored in memory 90.

As an alternative to this, however, a calibration action may be scheduled after expiration of a certain time interval. In order to take into account the asymptotic approach of the temperature of open- and closed-loop control unit 44 to a terminal value, the length of the time interval after the internal combustion engine is started should be increased in an appropriate manner.

The operation of an internal combustion engine with direct gasoline injection has been explained in the exemplified embodiment above. It is understood, however, that the method described can also be used in internal combustion engines that are operated with diesel fuel and are configured accordingly. Internal combustion engines that have an exhaust gas turbocharger and/or an exhaust gas recirculation system can also be operated using the method described above.

What is claimed is:

1. An internal combustion engine comprising:

at least one combustion chamber;

at least one injector to inject fuel directly into the combustion chamber;

at least one piezoactuator; and a control unit for operating an internal combustion engine, including:

a computer program executable on a computer of the control unit, including:

computer program code for performing a method for operating an internal combustion engine in which fuel is injected directly into a combustion chamber by an injector that has a piezoactuator, the method including:

determining an electrical charge, which is at least one of conveyed to and removed from the piezoactuator, by a process that is calibrated at least once during an operating time span of the internal combustion engine;

wherein the process for determining the electrical charge at least one of transferred to and removed from the piezoactuator is calibrated during at least one triggering off-time of the piezoactuator while the internal combustion engine is operating;

wherein the computer program is stored at a memory of the control unit, and wherein the control unit is one of an open-loop unit and a closed-loop unit.

2. A control unit for operating an internal combustion engine, comprising:

a computer program executable on a computer of the control unit, including:

computer program code for performing a method for operating an internal combustion engine in which fuel is injected directly into a combustion chamber by an injector that has a piezoactuator, the method including:

determining an electrical charge, which is at least one of conveyed to and removed from the piezoactuator, by a process that is calibrated at least once during an operating time span of the internal combustion engine;

wherein the process for determining the electrical charge at least one of transferred to and removed from the piezoactuator is calibrated during at least one triggering off-time of the piezoactuator while the internal combustion engine is operating;

wherein the computer program is stored at a memory of the control unit, and wherein the control unit is one of an open-loop unit and a closed-loop unit.

3. A computer program executable on a computer, comprising:

computer program code for performing a method for operating an internal combustion engine in which fuel is injected directly into a combustion chamber by an injector that has a piezoactuator, the method including:

determining an electrical charge, which is at least one of conveyed to and removed from the piezoactuator, by a process that is calibrated at least once during an operating time span of the internal combustion engine;

wherein the process for determining the electrical charge at least one of transferred to and removed from the piezoactuator is calibrated during at least one triggering off-time of the piezoactuator while the internal combustion engine is operating.

4. The computer program of claim 3, wherein it is stored at a memory or a flash memory.

5. A method for operating an internal combustion engine in which fuel is injected directly into a combustion chamber by an injector that has a piezoactuator, the method comprising:

determining an electrical charge, which is at least one of conveyed to and removed from the piezoactuator, by a process that is calibrated at least once during an operating time span of the internal combustion engine;

wherein the process for determining the electrical charge at least one of transferred to and removed from the piezoactuator is calibrated during at least one triggering off-time of the piezoactuator while the internal combustion engine is operating.

6. The method of claim 5, wherein the calibration is performed with the injector open, in the triggering off-time between an end of an opening triggering action and a beginning of a subsequent closing triggering action.

7. The method of claim 6, wherein for each working cycle of a cylinder of the internal combustion engine, there is at least one secondary injection and one main injection, and the calibration is performed during the main injection.

8. The method of claim 6, further comprising:

checking, before the calibration, in a rotation-speed-synchronous dynamic interrupt, whether a time between two triggering actions is sufficient for the calibration.

9. The method of claim 8, wherein an instruction necessary for the calibration is determined in the rotation-speed-synchronous dynamic interrupt.

10. The method of claim 6, wherein the calibration encompasses a plurality of individual calibration actions.

11. The method of claim 10, wherein a number of actions possible per working cycle of a cylinder is limited to a specific value, and only as many calibration actions as will permit all intended injection actions to be performed are allowed during one working cycle of the cylinder.

12. The method of claim 5, wherein a calibration action is scheduled at least when a temperature of a control unit has changed by at least a specific value since a last calibration action.

13. The method of claim 5, wherein a calibration action is scheduled at least after expiration of a specific time interval, a duration of the time interval increasing in a defined manner after a startup of the internal combustion engine.

14. The method of claim 5, wherein the calibration is performed during an overrun condition of the internal combustion engine.

* * * * *